US008977477B2

(12) United States Patent
Maki et al.

(10) Patent No.: US 8,977,477 B2
(45) Date of Patent: Mar. 10, 2015

(54) APPROACH FOR CONTROLLING OPERATION OF OIL INJECTORS

(71) Applicant: Ford Global Technologies, LLC, Dearborn, MI (US)

(72) Inventors: Clifford E. Maki, New Hudson, MI (US); Ralph Wayne Cunningham, Milan, MI (US); Jamie Charles Hanshaw, South Lyon, MI (US); Yihua (Eva) Barber, Novi, MI (US); David Bidner, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 261 days.

(21) Appl. No.: 13/644,568

(22) Filed: Oct. 4, 2012

(65) Prior Publication Data

US 2014/0100765 A1 Apr. 10, 2014

(51) Int. Cl.
*F01M 1/16* (2006.01)
*F01M 1/08* (2006.01)

(52) U.S. Cl.
CPC .. *F01M 1/16* (2013.01); *F01M 1/08* (2013.01)
USPC ..... 701/113; 123/41.34; 123/41.35

(58) Field of Classification Search
CPC ..... F01P 7/16; F01P 3/08; F01P 3/10; F01M 1/02; F01M 1/08; F01M 1/16
USPC ..... 701/113, 101; 123/41.02, 41.05, 41.34, 123/41.35, 196 R
See application file for complete search history.

(56) References Cited

U.S. PATENT DOCUMENTS

| | | | | |
|---|---|---|---|---|
| 5,503,116 | A * | 4/1996 | Wolf | 123/41.35 |
| 8,065,986 | B2 * | 11/2011 | Sachdev et al. | 123/196 R |
| 8,387,571 | B2 | 3/2013 | Ulrey et al. | |
| 2005/0120982 | A1 | 6/2005 | Ducu | |
| 2006/0065217 | A1 | 3/2006 | Ikegawa | |
| 2010/0018805 | A1 * | 1/2010 | Sachdev et al. | 184/6.3 |
| 2011/0144882 | A1 | 6/2011 | Bidner et al. | |
| 2013/0042826 | A1 * | 2/2013 | Melecosky et al. | 123/90.12 |
| 2013/0139768 | A1 * | 6/2013 | Takemoto | 123/41.02 |

FOREIGN PATENT DOCUMENTS

| | | | |
|---|---|---|---|
| JP | 2006029127 A | * | 2/2006 |
| JP | 2010236438 A | * | 10/2010 |

(Continued)

OTHER PUBLICATIONS

JP 2006029127A (Takao Suzuki) Feb. 2, 2006 (machine translation). [online] [retrieved on Aug. 8, 2014] Retrieved from JPO.*

(Continued)

*Primary Examiner* — Mahmoud Gimie
(74) *Attorney, Agent, or Firm* — Julia Voutyras; Alleman Hall McCoy Russell & Tuttle LLP

(57) ABSTRACT

Various embodiments of systems and methods related to controlling oil injection for piston cooling in an engine are disclosed. In one embodiment, a method includes during an engine cold start event, enabling oil injection onto a piston of an engine, disabling oil injection after the engine cold start event, and re-enabling oil injection after the engine cold start event based on a first operating parameter.

21 Claims, 6 Drawing Sheets

(56) References Cited

FOREIGN PATENT DOCUMENTS

| | | | |
|---|---|---|---|
| JP | 2012162996 A | * | 8/2012 |
| WO | 2011154806 A1 | | 12/2011 |

OTHER PUBLICATIONS

Maki, Cliff et al., "Engine Cover Plate," U.S. Appl. No. 13/749,585, filed Jan. 24, 2013, 26 pages.

* cited by examiner

APPROACH FOR CONTROLLING OPERATION OF OIL INJECTORS

BACKGROUND AND SUMMARY

Piston cooling jets or oil injectors may be implemented in an engine to provide engine cylinder cooling and lubrication. In particular, each oil injector sprays oil onto an underside of a corresponding piston to create a cooling effect on the piston. Furthermore, the oil propagates from the underside of the piston to the surrounding walls of a corresponding engine cylinder as the piston reciprocates in the engine cylinder to provide a cooling effect to the combustion chamber.

In one example, oil injector operation may be disabled at engine startup until the engine cylinders have reached an operating temperature that is suitable for stable combustion, at which point oil injector operation may be enabled. In this example, oil injector operation may be delayed to promote engine heating in order to reduce particulate matter generated as a result of incomplete combustion.

However, the inventors have recognized several potential issues with such an approach. For example, since the oil injectors are not operated until the engine reaches the designated operating temperature, there is a lack of initial lubrication of the pistons that causes piston slap and increased piston wear.

In one example, the above mentioned issues may be addressed by enabling oil injection onto a piston of an engine during an engine cold start event, disabling oil injection after the engine cold start event, and enabling oil injection after the engine cold start event based on a first operating parameter.

In one example, the oil injectors may be initially operated for just an initial few (e.g., 5-10) engine revolutions during the engine cold start event to suitably lubricate the pistons and cylinder walls. After the engine cold start event, the oil injectors may be disabled, and not operated for one or more engine cycles, to promote quick heating of the cylinders. In one example, the first operating parameter may be a designated operating temperature associated with stable combustion. Accordingly, operation of the oil injectors may be re-enabled after the cylinders have been heated to the designated operating temperature.

By initially enabling oil injection during the engine cold start event, noise, vibration, harshness (NVH) characteristics of the engine and wear on the pistons may be reduced relative to an approach that delays oil injector operation. In this way, drivability of the engine and an engine component lifespan may be increased.

Moreover, by disabling oil injection after the engine cold start event until the engine has reached a temperature suitable for stable combustion, and then re-enabling oil injector operation, the engine may be heated to an operating temperature more quickly than an approach that operates oil injectors continually from engine startup. In this way, particulate matter generated as a result of incomplete combustion may be reduced.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

The subject matter of the present disclosure will be better understood from reading the following detailed description of non-limiting embodiments, with reference to the attached drawings, wherein.

DETAILED DESCRIPTION

Figure 1:
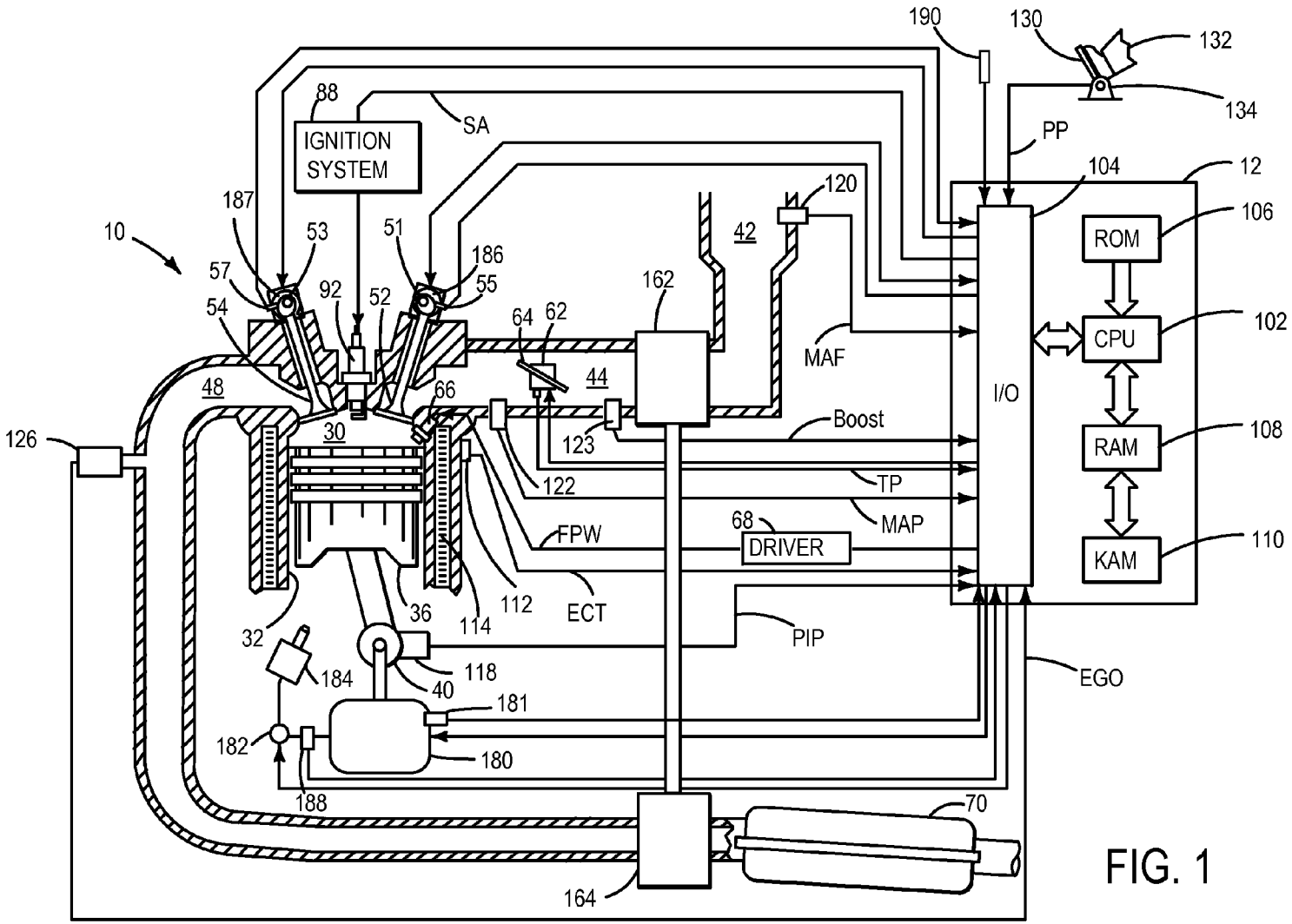
FIG. 1 shows an example embodiment of an engine system of the present disclosure.

The present disclosure relates to controlling operation of oil injectors in an engine. More particularly, the present disclosure relates to controlling operation of oil injectors (e.g., on/off times) to provide lubrication and cooling when appropriate while also promoting engine heating after an engine cold start event. In one example, oil injector operation may be initially enabled during an engine cold start event to inject oil onto pistons of the engine to provide lubrication for a selected number of combustion events from rest, such as only once or twice per cylinder, for example. Then, operation of the oil injectors may be disabled to promote engine heating. In particular, continuous operation of the oil injectors may inhibit heating of the cylinder walls after the engine cold start event. Once the engine has reached a suitable operating temperature for stable combustion, operation of the oil injectors may be re-enabled to provide oil for piston cooling.

Furthermore, operation of the oil injectors may be controlled while managing competing needs of various other engine subsystems. In some embodiments, the engine includes a variable flow oil pump that may be at least partially driven by the engine. The variable flow oil pump may be controlled in cooperation with the oil injectors based on operating conditions. In one example, when the oil injectors are disabled, an output flow rate of the variable flow oil pump may be reduced. In particular, the output demand of the oil pump is reduced when the oil injectors are disabled. Accordingly, the output flow rate of the oil pump may be reduced to reduce an oil pump load on the engine. In this way, fuel consumption may be reduced when the oil injectors are disabled.

In another example, when the oil injectors are enabled, an output flow rate of the variable flow oil pump may be adjusted based on engine load and engine temperature. For example, the output flow rate of the variable flow oil pump may be adjusted when an engine load is greater than an engine load threshold and an engine temperature is increasing at a rate that is greater than a temperature change threshold. Such operating conditions may be indicative of an increased need for cool of the pistons. By varying the output flow rate of the variable flow oil pump when the oil injectors are enabled, the oil injectors may provide an appropriate amount of oil onto the pistons to meet the cooling needs of the pistons without placing excess oil pump load on the engine. In this way, cooling need of the pistons may be met in an efficient manner across an operating temperature range of the engine.

As used herein, an engine cold start event may occur when an internal combustion engine is started from rest in a stopped or off state and an engine temperature is below a temperature that is suitable for stable combustion. For example, a suitable engine temperature for stable combustion may range from 195-230° F. In one example, the engine temperature corresponds to an engine coolant temperature. In some embodiments, the engine temperature may instead correspond to a cylinder temperature, an oil temperature, or an exhaust temperature each having a different temperature range associated with stable combustion. Note that stable combustion refers to combustion where fuel is substantially or completely combusted so as to produce little particulate matter relative to partial combustion that produces more particulate matter. Stable combustion may also be identified by having cylinder acceleration variation among the cylinders below a threshold value.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. For example, valve operation may be varied as part of pre-ignition abatement or engine knock abatement operations. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In one example, cam actuation systems 51 and 53 are variable cam timing systems that include cam phasers 186 and 187 that are hydraulically actuated via oil from a variable flow oil pump 180. Under some conditions, an output flow rate of variable flow oil pump 180 may be varied to control a response time for cam phasers 186 and 187 to change a position of the cams based on operating conditions. For example, under high engine loads, the output flow rate of the variable flow oil pump 180 may be increased, so that the cam phasers 186 and 187 change position more quickly and correspondingly change a position of the cams more quickly than under low engine loads.

Engine 10 may further include a compression device such as a turbocharger or supercharger including at least a compressor 162 arranged along intake manifold 44. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A boost sensor 123 may be positioned downstream of the compressor in intake manifold 44 to provide a boost pressure (Boost) signal to controller 12.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30. Fuel injector 66 may be controlled to vary fuel injection in different cylinder according operating conditions. For example, controller 12 may command fuel injection to be stopped in one or more cylinders as part of pre-ignition abatement operations so that combustion chamber 30 is allowed to cool. Further, intake valve 52 and/or exhaust valve 53 may be opened in conjunction with the stoppage of fuel injection to provide intake air for additional cooling.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Controller 12 may vary signal SA based on operating conditions. For example, controller may retard signal SA in order to retard spark in response to an indication of engine knock as part of engine knock abatement operations. Though spark ignition components are shown, in some embodiments, combustion chamber 30 or one or more other combustion chambers of engine 10 may be operated in a compression ignition mode, with or without an ignition spark.

Variable flow oil pump 180 can be coupled to crankshaft 40 to provide rotary power to operate the variable flow oil pump 180. In one example, the variable flow oil pump 180 includes a plurality of internal rotors (not shown) that are eccentrically mounted. At least one of the internal rotors can be controlled by controller 12 to change the position of that rotor relative to one or more other rotors to adjust an output flow rate of the variable flow oil pump 180 and thereby adjusted the oil pressure. For example, the electronically controlled rotor may be coupled to a rack and pinion assembly that is adjusted via the controller 12 to change the position of the rotor. The variable flow oil pump 180 may selectively provide oil to various regions and/or components of engine 10 to provide cooling and lubrication. The output flow rate or oil pressure of the variable flow oil pump 180 can be adjusted by the controller 12 to accommodate varying operating conditions to provide varying levels of cooling and/or lubrication. Further, the oil pressure output from the variable flow oil pump 180 may be adjusted to reduce oil consumption and/or reduce energy consumption by the variable flow oil pump 180.

It will be appreciated that any suitable variable flow oil pump configuration may be implemented to vary the oil pressure and/or oil output flow rate. In some embodiments, instead of being coupled to the crankshaft 40 the variable flow oil pump 180 may be coupled to a camshaft, or may be powered by a different power source, such as a motor or the like.

Oil injector 184 may be coupled downstream of an output of the variable flow oil pump 180 to selectively receive oil from the variable flow oil pump 180. In some embodiments, the oil injector 184 may be incorporated into the combustion chamber walls 32 of the engine cylinder and may receive oil from galleries formed in the walls. The oil injector 184 may be operable to inject oil from the variable flow oil pump 180 onto an underside of piston 36. The oil injected by oil injector 184 provides cooling effects to the piston 36. Furthermore, through reciprocation of piston 36, oil is drawn up into combustion chamber 30 to provide cooling effects to walls of the combustion chamber 30. Moreover, oil injector 184 provides oil for lubrication of an interface between piston 36 and combustion chamber 30.

A valve 182 may be positioned between the output of the variable flow oil pump 180 and the oil injector 184 to control flow of oil to the oil injector 184. In some embodiments, the check valve may be integrated into the assembly of the oil injector 184. In some embodiments, the valve 182 may be an electronically actuatable valve that is controlled by controller 12. The valve 182 may be actuatable to enable/disable operation of oil injector 184.

Exhaust gas sensor 126 is shown coupled to exhaust passage 48 upstream of emission control device 70. Sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air-fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. Moreover, these sensors may be used to derive an indication of engine load.

Furthermore, controller 12 may receive signals that may be indicative of a various temperatures related to the engine 10. For example, engine coolant temperature (ECT) from temperature sensor 112 coupled to cooling sleeve 114 may be sent to controller 12. In some embodiments, sensor 126 may provide an indication of exhaust temperature to controller 12. Sensor 181 may provide an indication of oil temperature or oil viscosity to controller 12. One or more of these sensors may provide an indication of an engine temperature that may be used by controller 12 to control operation of the oil injector 184. Controller 12 may receive signals indicative of an ambient temperature from sensor 190. For example, the engine temperature and/or the ambient temperature may be used to control oil injection as will be discussed in further detail below.

Further, controller 12 may receive an indication of oil pressure from pressure sensor 188 positioned downstream of an output of variable flow oil pump 180. The oil pressure indication may be used by the controller 12 to control adjustment of oil pressure by varying an output flow rate of variable flow oil pump 180.

As discussed above, controller 12 may control operation of oil injector 184 based on various operating conditions. In one example, controller 12 includes a processor and computer-readable medium having instructions that when executed by the processor: enable oil injection onto piston 36 via oil injector 184 during an engine cold start event. In one example, controller 12 actuates valve 182 to enable operation of oil injector 184. In one example, the engine cold start event occurs when engine 10 is started from rest and an engine temperature is below a designated cold start temperature threshold. For example, the cold start temperature threshold may be less than an engine operating temperature (e.g., 195° F.).

Further, the computer-readable medium has instructions that when executed by the processor: disable oil injection via oil injector 184 after the engine cold start event. For example, oil injection may be disabled after an initial few engine rotations. In one example, the engine cold start event lasts for less than ten engine rotations, and controller 12 is configured to operate oil injector 184 for a designated number of initial engine rotations during the engine cold start event. In one example, controller 12 actuates valve 182 to disable operation of oil injector 184. It will be appreciated that the engine cold start event may last for any suitable number of rotations. Oil injector 184 may be initially enabled during the engine cold start event to provide lubrication to piston 36 and cylinder 30 in order to reduce the likelihood of piston slap and reduce wear on piston 36, in particular a skirt portion of piston 36. Oil injector 184 may be disabled after the initial operation for lubrication to promote heat of engine 10.

Further, the computer-readable medium has instructions that when executed by the processor: re-enable oil injection after the engine cold start event based on a first operating parameter. In one example, the first operating parameter corresponds to an engine temperature at which stable combustion may occur, and at which point piston 36 may be cooled. In particular, the first operating parameter may include an engine temperature that may be derived from an engine coolant temperature, an oil temperature, an exhaust temperature, or a combination thereof, for example. In other embodiments, the first operating parameter may some other indication of stable combustion, such as a designated air/fuel threshold. In another embodiment, the operating parameter include a piston temperature that may be inferred based on a function of engine speed, engine load, engine coolant temperature, and spark timing.

In some embodiments, the computer-readable medium has instructions that when executed by the processor: vary an oil injection amount injected by oil injector 184 during the engine cold start event based on a second operating parameter. For example, the second operating parameter may include a cylinder temperature, an oil temperature, inferred piston temperature, or an oil viscosity. In one particular example, the oil injection amount may be increased as the temperature increases/oil viscosity decreases and the oil injection amount may be decreased as the temperature decreases/oil viscosity increases. It will be appreciated that the oil injection amount may vary from one engine cold start event to the next engine cold start event based on the second operating parameter.

In some embodiments, the oil injection amount may be varied by enabling operation of oil injector 184 for more or less engine rotations. In one example, at lower engine temperatures (e.g., less than 100° F.), oil injector 184 is enabled to inject oil for three engine rotations. Further, at higher engine temperatures (e.g., greater than 100° F.), oil injector 184 is enabled to inject oil for six engine rotations. It will be appreciated that the oil injection amount may be varied by injecting oil via oil injector 184 for any suitable number of engine rotations.

In some embodiments, the oil injection amount may be varied by controlling variable flow oil pump 180 to vary an output flow rate to increase or decrease oil pressure. In one example, at lower engine temperatures, the output flow rate may be decreased, and at higher engine temperatures the output flow rate may be increased. It will be appreciated that the oil injection amount may be varied by varying the output flow rate of oil pump 180 to achieve any suitable oil pressure.

In some embodiments, the computer-readable medium has instructions that when executed by the processor: reduce the output flow rate of variable flow oil pump 180 in response to disabling oil injection via oil injector 184 after the engine cold start event. The output flow rate of the oil pump may be decreased when the oil injector is turned off, because the oil demand is reduced. By reducing the output flow rate of the oil pump, a load of the oil pump on the engine may be reduced, and engine efficiency may be increased. In this way, fuel consumption of the engine may be reduced.

In some embodiments, the computer-readable medium has instructions that when executed by the processor: increase a flow rate of variable flow oil pump 180 while oil injection via oil injector 184 is disabled in response to a commanded change in cam phaser position of cam phasers 186 and 187. By increasing the output flow rate of the oil pump when the oil injector is disabled, oil pressure in the VCT system may be increased to increase a response speed of the cam phasers to more quickly change a position of the cams. Moreover, the increase in oil pressure in the VCT system may increase a range of operation of the cam phasers.

In some embodiments, the computer-readable medium has instructions that when executed by the processor: increase an output flow rate of variable flow oil pump 180 while oil injection is re-enabled via oil injector 184 based on an engine load being and an engine temperature. For example, the output flow rate may be increased (e.g., to a maximum flow rate) in response to the engine load being greater than an engine load threshold and the engine temperature increasing at a rate that is greater than a temperature change threshold. In other words, the output flow rate of the oil pump may be increased during high load conditions when the engine temperature is increasing in order to provide additional oil via the oil injector for additional cooling. In this way, the piston and cylinder may be suitable cooled event at higher temperatures.

In another example, controller 12 includes a processor and computer-readable medium having instructions that when executed by the processor: enable oil injection onto a piston of an engine at an engine start event, during a first mode of operation, maintain oil injection after the engine start event, and during a second mode of operation, disable oil injection after the engine start event, and re-enable oil injection based on a first operating parameter. In one example, operation may be switched between the first and second mode based on comparing an oil temperature relative to a piston temperature. For example, the comparison indicates whether the engine is suitably warm at engine start to achieve stable combustion. If the oil temperature is substantially equal to or greater than the piston temperature, then the engine operates in the first mode. Otherwise, the engine operates in the second mode.

For example, the first operating parameter may include a piston temperature, and oil injection may be re-enabled when the piston temperature is greater than a temperature threshold that is indicative of a temperature at which engine knock may occur. This approach differs from the other approach described above because it involves an engine start event that is not temperature specific (e.g., not an engine cold start event). Another difference is that, in some cases, oil injection may be maintained after engine startup or not disabled. In other cases, oil injection and may be disabled after engine startup, and later re-enabled.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and that each cylinder may similarly include its own set of intake/exhaust valves, fuel injector, spark plug, oil injector etc.

The configurations illustrated above enable various methods for varying operation of oil injectors and corresponding components, such as the variable flow oil pump and VCT system in cooperation to efficiently provide oil for lubrication, cooling, and component actuation when appropriate in view of operating conditions in order reduce a load of these components on the engine. Accordingly, some such methods are now described, by way of example, with continued reference to above configurations. It will be understood, however, that these methods, and others fully within the scope of the present disclosure, may be enabled via other configurations as well.

It will be understood that the example control and estimation routines and methods disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in an electronic control system.

It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Figure 2:
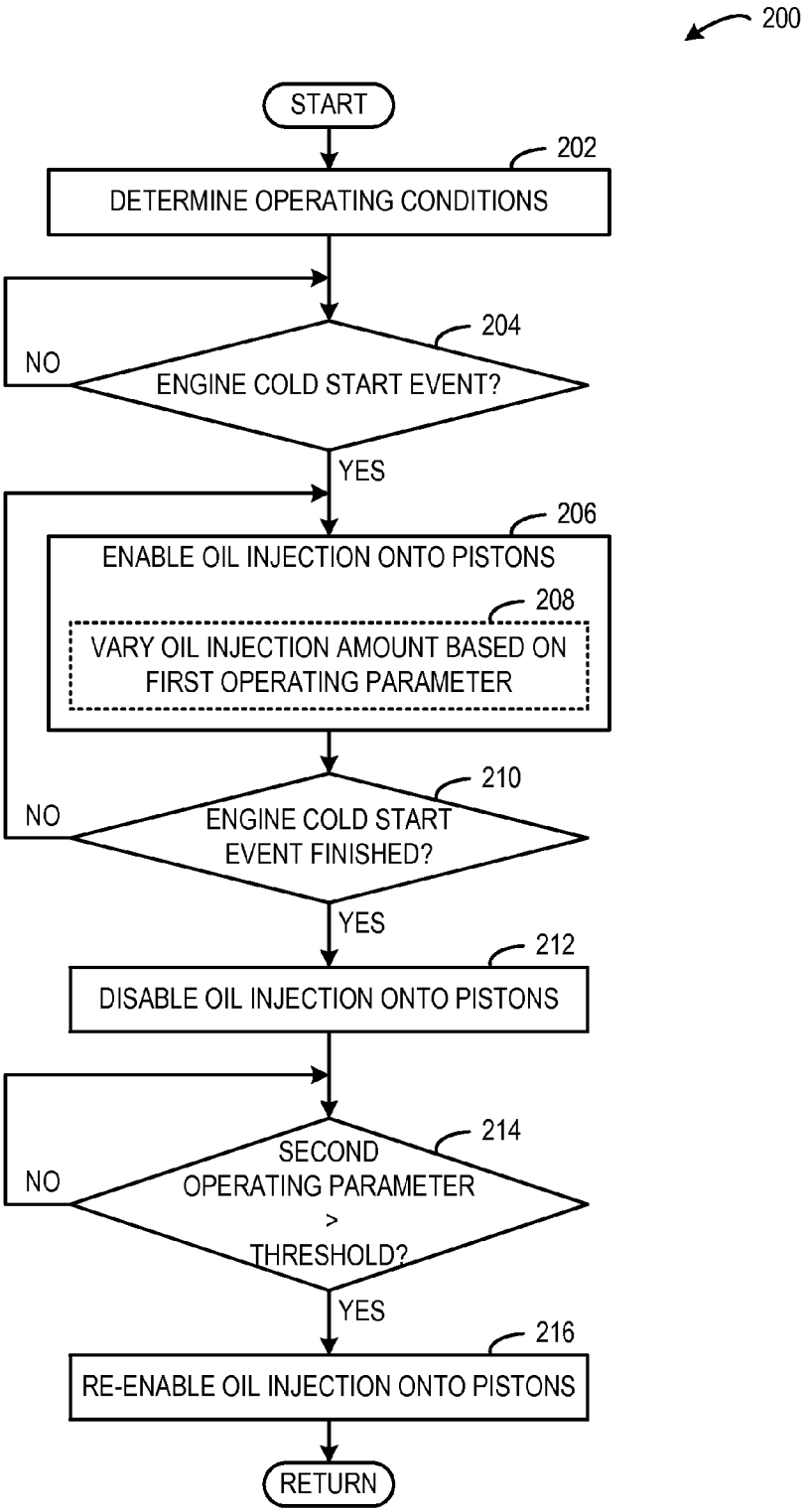
FIG. 2 shows a method for controlling oil injection to accommodate different operating conditions according to an embodiment of the present disclosure.

FIG. 2 shows an example embodiment of a method 200 for controlling oil injection to accommodate different operating conditions. In one example, the method 200 may be performed by controller 12 shown in FIG. 1. At 202, the method 200 may include determining operating conditions. Determining operating conditions may include receiving information from various components of engine 10. For example, the controller 12 may receive operating state information of the variable flow oil pump 180, such as an output flow rate or oil pressure setting, operating state information of various valves including valve 182, etc. Furthermore, determining operating condition may include monitoring various parameters of engine 10 or receiving signals from various sensors coupled to engine 10. The parameters monitored may include, for example, engine/cylinder temperature, cylinder pressure, engine oil temperature, engine oil pressure, engine oil viscosity, air/fuel ratio, engine load, engine speed, etc.

At 204, the method 200 includes determining whether there is an engine cold start event. For example, an engine cold start event may be determined based on a commanded engine start from a vehicle operator, for example via an ignition key. In some cases, an engine cold start event may occur when the engine is started and the engine temperature is less than a temperature threshold (e.g., less than 100° F.). If it is determined that an engine cold start event is occurring, then the method 200 moves to 206. Otherwise, the method 200 returns to 204.

At 206, the method 200 includes enabling oil injection onto pistons of the engine. Oil injection may be enabled during the engine cold start event to provide lubrication in order to reduce piston slap and piston skirt wear.

In some embodiments, at 208, the method 200 includes varying an oil injection amount during the engine cold start event based on an operating parameter. For example, the operating parameter may include an engine/cylinder temperature, an oil temperature, an inferred piston temperature, or an oil viscosity. In one example, the oil injection amount is increased as temperature increases or viscosity decreases, and the oil injection amount is decreased as temperature decreases or viscosity increases. In some embodiments, the oil injection amount is varied by adjusting a number of engine revolutions that oil injection is enabled.

At 210, the method 210 includes determining whether the engine cold start event is finished. For example, the engine cold start event may be finished after a designated number of engine revolutions. Other examples for determine whether the engine cold start event is finished includes monitoring air/fuel ratio to indicate combustion, monitoring engine speed to reach an engine speed threshold indicative of an engine start. If it is determined that the engine cold start event is finished, then the method 200 moves to 212. Otherwise, the method 200 returns to 206.

At 212, the method 200 includes disabling oil injection onto the pistons of the engine. Oil injection may be disabled after the engine cold start event to promote cylinder heating, so that more complete combustion can be achieved quickly.

At 214, the method 200 includes determining whether an operating parameter is greater than a threshold. In one example, the operating parameter is engine temperature, and the threshold corresponds to a temperature at which stable combustion occurs in the engine (e.g., an engine coolant temperature ranging from 190-235° F.). It will be appreciated that any suitable operating parameter that indicates stable combustion or suitable cylinder heating may be used in place of or in cooperation with engine temperature in the method. For example, control of oil injection may be varied based on an inferred piston temperature. If the engine temperature is greater than the temperature threshold, then the method 200 moves to 216. Otherwise, the method 200 returns to 214.

Note that the operating parameter for varying the oil injection amount during the engine cold start event may be a different operating parameter or may have different thresholds than this operating parameter.

At 216, the method 200 includes re-enabling oil injection onto the pistons of the engine. For example, oil injection may be re-enabled after the engine has heated to a suitable operating temperature in order to provide piston cooling.

By enabling oil injection at cold start, the pistons may be suitable lubricated. By disabling oil injection after the cold start, the engine may be heated quickly to reduce the generation of particulate matter due to incomplete combustion. By re-enabling oil injection once the engine has heated to a suitable temperature for full combustion, the pistons may be cooled at higher temperatures.

Figure 3:
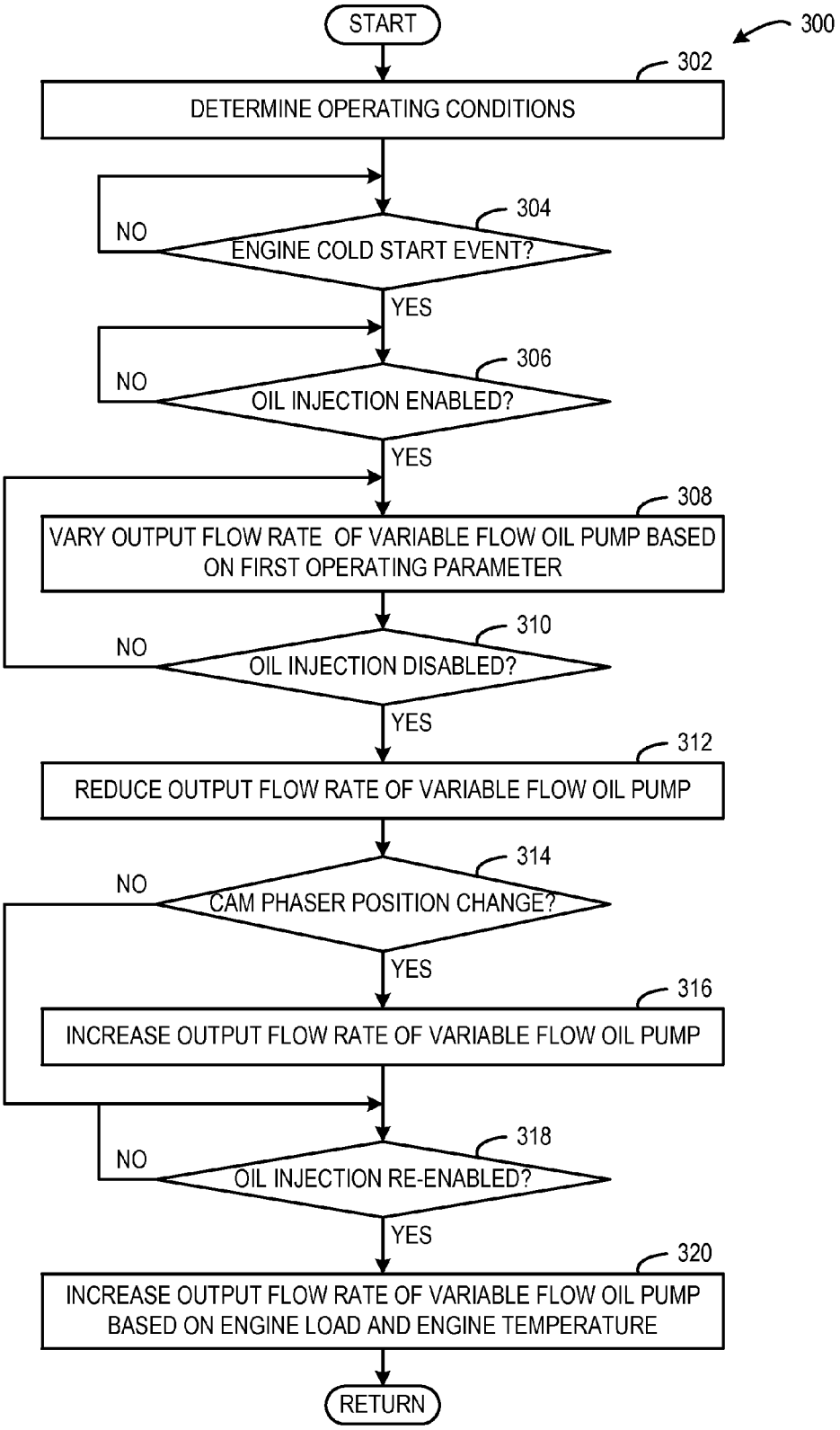
FIG. 3 shows a method for controlling operation of a variable flow oil pump in coordination with operation of oil injectors to accommodate different operating conditions according to an embodiment of the present disclosure.

FIG. 3 shows an example embodiment of a method 300 for controlling oil injection to accommodate different operating conditions in an engine having a variable flow oil pump that supplies oil to oil injectors. In one example, the method 200 may be performed by controller 12 shown in FIG. 1. At 302, the method 300 includes determining operating conditions.

At 304, the method 300 includes determining whether an engine cold start event is occurring. If it is determined that an engine cold start event is occurring, then the method 300 moves to 306. Otherwise, the method 200 returns to 304.

At 306, the method 300 includes determining whether the oil injectors are enabled to inject oil onto pistons of the engine. If it is determined that oil injection is enabled, then the method 300 moves to 308. Otherwise, the method 200 returns to 306.

At 308, the method 300 includes varying an output flow rate of the variable flow oil pump based on an operating parameter. For example, the operating parameter may include an engine/cylinder/piston temperature, an oil temperature, or an oil viscosity. In one example, the output flow rate increases as temperature increased or viscosity decreases, and the output flow rate decreases as temperature decreases or viscosity increases.

At 310, the method 300 includes determining whether the engine cold start event is finished. If it is determined that the engine cold start event is finished, then the method 300 moves to 312. Otherwise, the method 300 returns to 308.

At 312, the method 300 includes reducing an output flow rate of the variable flow oil pump. The output flow rate may be reduced when oil injection is disabled in order to reduce an oil pump load on the engine, and thereby reduce fuel consumption of the engine.

At 314, the method 300 includes determining whether a change in cam position is commanded. If it is determined that a change in cam position is commanded, then the method 300 moves to 316. Otherwise, the method 300 moves to 318.

At 316, the method 300 includes increasing the output flow rate of the variable flow oil pump. In one example, the output flow rate is increased to a maximum capability of the oil pump. The output flow rate may be increased in order to increase an operation speed of the VCT system, and more particularly, a speed or range of operation of the cam phasers that are hydraulically actuated. In this way, the cam shaft position change response time may be decreased.

At 318, the method 300 includes determining whether oil injection is re-enabled. If it is determined that oil injection is re-enabled, then the method 300 moves to 320. Otherwise, the method 300 returns to 318.

At 320, the method 300 includes increasing an output flow rate of the variable flow oil pump based on engine load and engine temperature. For example, the output flow rate may be increased (e.g., to a maximum capability) when the engine is operating with a high load and temperature is increasing in order to provide increased cooling to the pistons. In one example, the output flow rate is increased responsive to an engine load being greater than an engine load threshold and a rate of temperature change being greater than a rate of change threshold.

By controlling the variable flow oil pump in cooperation with operation of the oil injectors, the oil needs of various engine components may be met in an efficient manner over the entire operating range of the engine.

Figure 4:
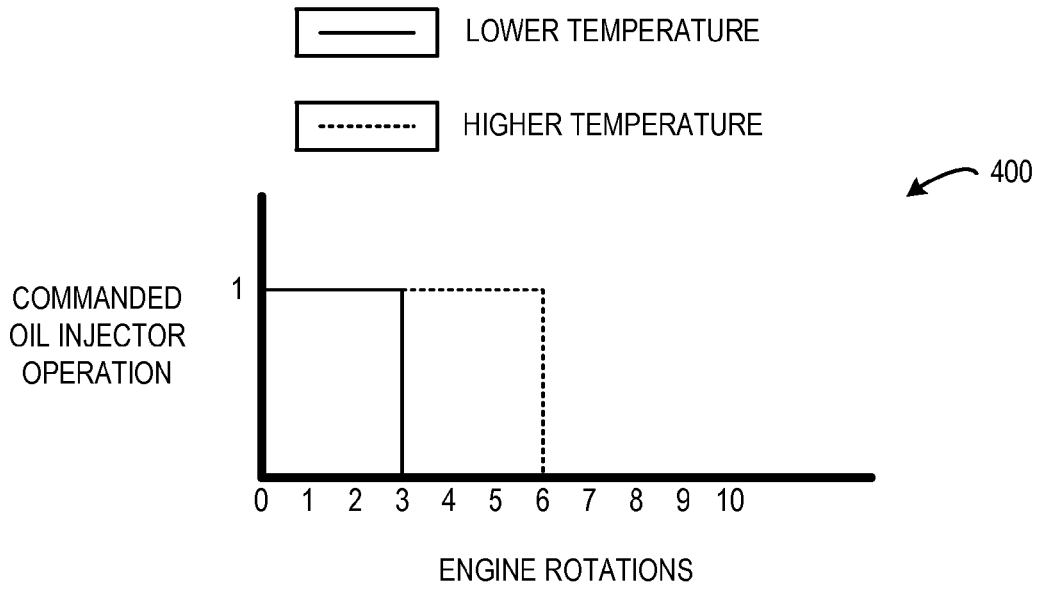
FIGS. 4-5 show graphs of examples in which an oil injection amount injected during an engine cold start event is varied.
Figure 5:
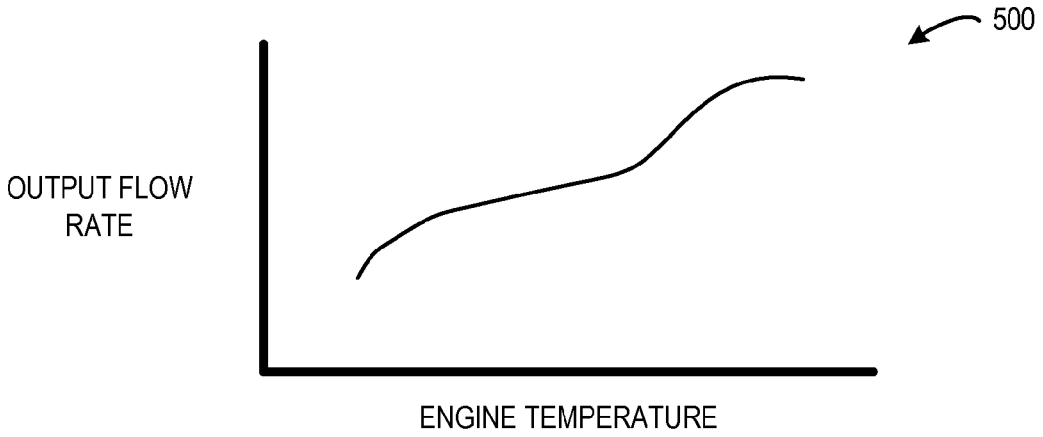

FIGS. 4-5 show graphs of examples in which an oil injection amount injected during an engine cold start event is varied based on an operation parameter. In these examples, the operating parameter is engine temperature. FIG. 4 shows a graph 400 of an example in which an oil injection amount injected during an engine cold start event is varied by injecting a fixed amount of oil for a different number of engine rotations. The graph 400 plots an oil injector operation command signal versus a number of engine rotations. In particular, the oil injector command signal goes to one at engine startup to enable oil injection during an engine cold start event to enable operation of the oil injectors. While enabled, the oil injectors inject a substantially fixed amount of oil during each engine rotation to provide an oil injection amount during the engine cold start event. At lower temperatures (indicated by a solid line), the oil injector operation command signal goes to zero after three engine rotations to disable oil injector operation. At higher temperatures (indicated by a dashed line), the oil injector operation command signal goes to zero after six engine rotations to disable oil injector operation. In other words, at higher temperatures the oil injectors are operated for a greater number of engine revolutions than at lower temperatures in order to increase the amount of oil injected during the engine cold start event. Note that although the engine temperature may be indicated as higher, the engine temperature may still be less than an engine temperature that is suitable for stable combustion or a hot re-start that would cause the oil injector to remain enabled. It will be appreciated that the oil injector operation timing is merely exemplary and the oil injectors may be enabled for any suitable number of engine rotations during an engine cold start event to provide suitable lubrication to the pistons.

FIG. 5 shows a graph 500 of an example in which an oil injection amount injected during an engine cold start event is varied by varying an output flow rate of the oil injectors. The graph 500 plots an output flow rate of an oil injector versus an engine temperature. In one example, the output flow rate may be varied by adjusting an output flow rate (or oil pressure) of a variable flow oil pump that supplies oil to the oil injectors. In particular, the output flow rate increases as engine temperature increases. It will be appreciated that the illustrated function is merely exemplary and that any suitable function may be used to control the output flow rate of oil injected during an engine cold start event.

In some embodiments, the oil injectors may be operated for a set amount of time or a set number of engine rotations during an engine cold start event and the output flow rate may be varied to vary the oil injection amount. In some embodiments, the oil injectors may be operated for a variable amount of time or a variable number of engine rotations and the output flow rate may be varied in cooperation to vary the oil injection amount.

Figure 6:
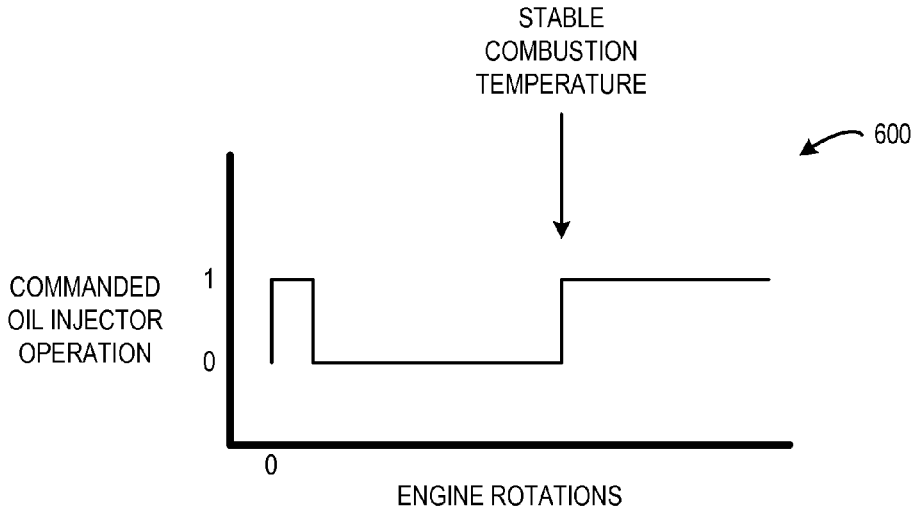
FIG. 6 shows a graph of an example of oil injector operation starting at an engine cold start event.

FIG. 6 shows a graph 600 of an example of oil injector operation starting at an engine cold start event. The graph 600 plots an oil injector operation command signal versus a number of engine rotations. In particular, the oil injector command signal goes to one at engine startup to enable oil injection during the engine cold start event. After initial lubrication is provided, the oil injector command signal goes to zero to disable operation of the oil injectors. By disabling the oil injectors, the engine may heat more quickly to an engine temperature that corresponds with stable combustion. The oil injectors are disabled until the engine temperature is greater than an engine temperature threshold that corresponds with stable combustion. Once the engine temperature is greater than the engine temperature threshold, the command signal goes to one to re-enable oil injector operation.

Figure 7:
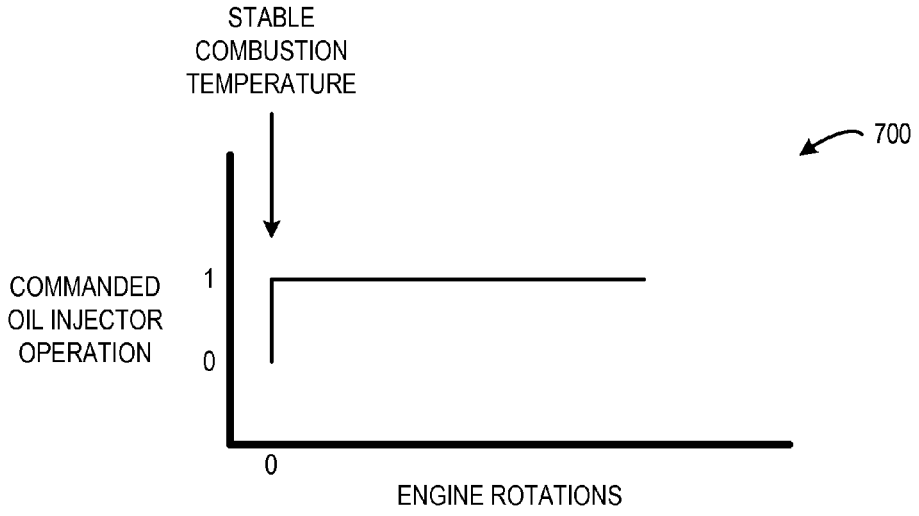
FIG. 7 shows a graph of an example of oil injector operation starting at a hot engine re-start event.

FIG. 7 shows a graph 700 of an example of oil injector operation starting at a hot engine re-start event. The graph 700 plots an oil injector operation command signal versus a number of engine rotations. In particular, the oil injector command signal goes to one at engine startup to enable oil injection during the hot re-start event. At the time of the hot re-start, the engine temperature is greater than the engine temperature threshold that corresponds with stable combustion, thus the oil injection command signal remain at one to enable operation of the oil injectors.

Figure 8:
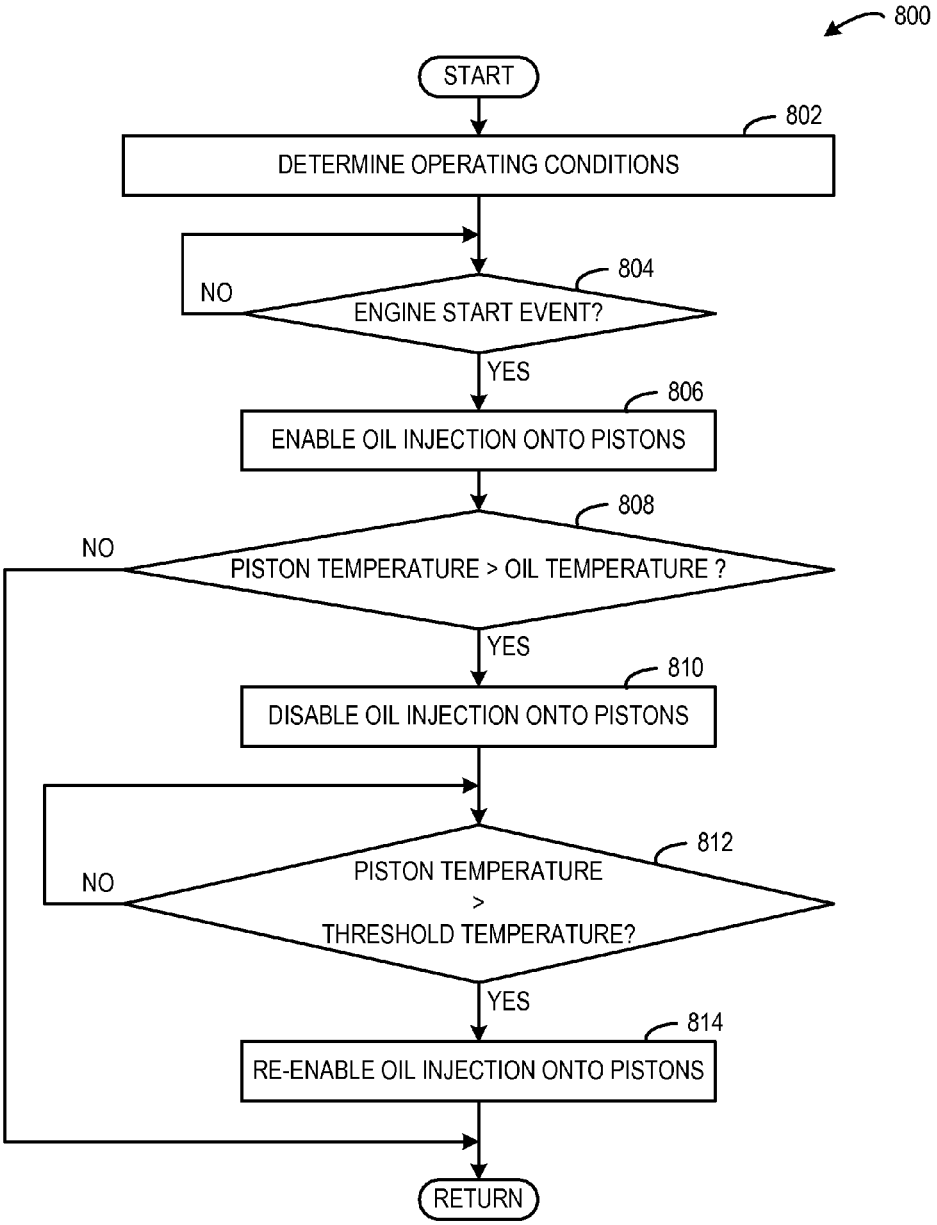
FIG. 8 shows a method for controlling oil injection in different modes of operation according to an embodiment of the present disclosure.

FIG. 8 shows an example of another embodiment of a method 800 for controlling oil injection to accommodate different operating conditions. The method 800 differs from the method 200, for example, by switching between different modes of operation where oil injection is remains enabled throughout operation or enabled/disabled throughout operation based on an inferred piston temperature, among other operating parameters. In one example, the method 800 may be performed by controller 12 shown in FIG. 1. At 802, the method 800 may include determining operating conditions.

At 804, the method 800 includes determining whether there is an engine start condition. If there is an engine start condition, then the method 800 moves to 806. Otherwise, the method 800 returns to 804.

At 806, the method 800 enabling oil injection onto pistons of the engine. Oil injection may be provided by oil injectors to provide lubrication for the pistons from engine startup. In one example, the engine start event may include the initial rotations of the engine during startup. In one particular example, the engine start event is ten or less revolutions of the engine.

At 808, the method 800 includes determining whether a piston temperature is greater than an oil temperature. For example, the piston temperature may be inferred. In particular, the piston temperature may be inferred based on a function of one or more of engine speed, engine load, engine coolant temperature, and spark timing.

This determination may be used to switch between two different modes of operation. In a first mode, when the oil temperature is substantially equal to or greater than the piston temperature, oil injection may be maintained throughout operation to provide lubrication and cooling. In particular, since the oil temperature is greater than the piston temperature, the engine may be suitable heated and there may be substantially no heat transfer from the piston/cylinder to the oil. In other words, oil injection does not need to be disabled in this mode because the cylinder does not need to be heated for the purpose of achieving stable combustion.

On the other hand, in the second mode, when the oil temperature is less than the piston temperature, oil injection may be disabled in order to promote engine heating to achieve stable combustion. If the piston temperature is greater than the oil temperature, then the method 800 moves to 810. Otherwise, the method 800 returns to other operations.

At 810, the method 800 includes disabling oil injection onto the pistons of the engine.

At 812, the method includes determining whether the piston temperature is greater than a temperature threshold. In some embodiments, the temperature threshold may be a cylinder temperature at which engine knock may occur. In particular, the temperature threshold may vary depending of operating conditions. In one example, the temperature threshold is derived from a function of ambient temperature and engine speed. For example, at lower ambient temperatures, engine knock is less likely to occur, so the temperature threshold may be increased so that the oil injectors are disabled until the piston temperature increases to a higher temperature than at higher ambient temperatures.

It will be appreciated that other operating parameters may be used in place of piston temperature to control operation of the oil injectors without departing from the scope of the present disclosure. If the piston temperature is greater than the temperature threshold, them the method 800 moves to 814. Otherwise, the method 800 returns to 812.

At 814, the method 800 includes re-enabling oil injection onto the pistons of the engine.

By operating in different modes based on the temperature state of the engine, oil injection may be provided in an efficient manner to provide cooling and lubrication.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A method comprising:

during an engine cold start event, enabling oil injection via at least one oil injector onto a piston of an engine;

disabling oil injection via the at least one oil injector after the engine cold start event; and re-enabling oil injection via the at least one oil injector after the engine cold start event based on a first operating parameter.

2. The method of claim 1, further comprising:

varying an oil injection amount during the engine cold start event based on a second operating parameter.

3. The method of claim 2, wherein the second operating parameter includes a cylinder temperature, an oil temperature, or an oil viscosity.

4. The method of claim 1, wherein the first operating parameter includes an engine temperature.

5. The method of claim 1, wherein the first operating parameter includes an inferred piston temperature.

6. The method of claim 1, wherein the engine includes a variable flow oil pump and the method further comprises:

adjusting a flow rate of the variable flow oil pump while oil injection via the at least one oil injector is enabled during the engine cold start event to vary an oil injection amount based on a second operating parameter; and reducing an output flow rate of the variable flow oil pump in response to disabling oil injection via the at least one oil injector after the engine cold start event.

7. The method of claim 6, wherein the engine further includes a variable cam timing system including a cam phaser that is hydraulically actuated via oil from the variable flow oil pump and the method further comprises:

increasing a flow rate of the variable flow oil pump while oil injection via the at least one oil injector is disabled in response to a commanded change in cam phaser position.

8. The method of claim 6, further comprising:

increasing an output flow rate of the variable flow oil pump while oil injection via the at least one oil injector is re-enabled based on an engine load and an engine temperature.

9. An engine system comprising:

at least one cylinder;

at least one piston positioned in the at least one cylinder;

at least one oil injector operable to inject oil onto the at least one piston; and a controller including a processor and computer-readable medium having instructions that when executed by the processor:

during an engine cold start event, enable oil injection onto the at least one piston via the at least one oil injector;

disable oil injection via the at least one oil injector after the engine cold start event; and re-enable oil injection via the at least one oil injector after the engine cold start event based on a first operating parameter.

10. The engine system of claim 9, wherein the computer-readable medium has instructions that when executed by the processor:

vary an oil injection amount injected by the at least one oil injector during the engine cold start event based on a second operating parameter.

11. The engine system of claim 10, wherein the second operating parameter includes a cylinder temperature, an oil temperature, or an oil viscosity.

12. The engine system of claim 9, wherein the first operating parameter includes an engine temperature.

13. The engine system of claim 9, further comprising:

a variable flow oil pump to supply oil to the at least one oil injector; and wherein the computer-readable medium has instructions that when executed by the processor:

adjust a flow rate of the variable flow oil pump while oil injection is enabled via the at least one oil injector during the engine cold start event to vary an oil injection amount based on a second operating parameter.

14. The engine system of claim 13, wherein the computer-readable medium has instructions that when executed by the processor:

reduce an output flow rate of the variable flow oil pump in response to disabling oil injection via the at least one oil injector after the engine cold start event.

15. The engine system of claim 13, further comprising:

a variable cam timing system including a cam phaser that is hydraulically actuated via oil from the variable flow oil pump; and wherein the computer-readable medium has instructions that when executed by the processor:

increase a flow rate of the variable flow oil pump while oil injection via the at least one oil injector is disabled in response to a commanded change in cam phaser position.

16. The method of claim 13, wherein the computer-readable medium has instructions that when executed by the processor:

increase an output flow rate of the variable flow oil pump while oil injection is re-enabled via the at least one oil injector based on an engine load and an engine temperature.

17. An engine system comprising:

at least one cylinder;

at least one piston positioned in the at least one cylinder;

at least one oil injector operable to inject oil onto the at least one piston;

a variable flow oil pump to supply oil to the at least one oil injector; and a controller including a processor and computer-readable medium having instructions that when executed by the processor:

during an engine cold start event, enable oil injection onto the at least one piston via the at least one oil injector;

adjust a flow rate of the variable flow oil pump while oil injection is enabled during the engine cold start event to vary an oil injection amount based on a first operating parameter;

disable oil injection via the at least one oil injector after the engine cold start event; and re-enable oil injection via the at least one oil injector after the engine cold start event based on a second operating parameter.

18. The engine system of claim 17, wherein the first operating parameter includes a cylinder temperature, an oil temperature, or an oil viscosity, and the second operating parameter includes an engine temperature.

19. The engine system of claim 17, wherein the computer-readable medium has instructions that when executed by the processor:

reduce an output flow rate of the variable flow oil pump in response to disabling oil injection via the at least one oil injector after the engine cold start event; and increase an output flow rate of the variable flow oil pump while oil injection via the at least one oil injector is re-enabled based on an engine load being an engine temperature.

20. The engine system of claim 17, further comprising:

a variable cam timing system including a cam phaser that is hydraulically actuated via oil from the variable flow oil pump; and wherein the computer-readable medium has instructions that when executed by the processor:

increase a flow rate of the variable flow oil pump while oil injection is disabled in response to a commanded change in cam phaser position.

21. A method comprising:

enabling oil injection via at least one oil injector onto a piston of an engine at an engine start event;

during a first mode of operation, maintaining oil injection after the engine start event; and during a second mode of operation, disabling oil injection via the at least one oil injector after the engine start event, and re-enabling oil injection via the at least one oil injector based on a first operating parameter.

* * * * *